US005748211A

United States Patent [19]

Shinozaki et al.

[11] Patent Number: 5,748,211

[45] Date of Patent: May 5, 1998

[54] RECORDING HEAD AND RECORDING APPARATUS

[75] Inventors: Kenji Shinozaki; Hideki Hirano, both of Kanagawa, Japan

[73] Assignee: Sony Corporation, Tokyo, Japan

[21] Appl. No.: 434,853

[22] Filed: May 4, 1995

[30] Foreign Application Priority Data

May 6, 1994 [JP] Japan ..... 6-117570

[51] Int. Cl.[6] ..... B41J 2/14

[52] U.S. Cl. ..... 347/51; 347/46

[58] Field of Search ..... 347/51, 20, 52, 347/1, 54, 100, 46

[56] References Cited

U.S. PATENT DOCUMENTS 5,021,808 6/1991 Kohyama ..... 347/51

5,594,480 1/1997 Sato et al. ..... 347/51

*Primary Examiner*—Benjamin R. Fuller

*Assistant Examiner*—Juanita Stephens

*Attorney, Agent, or Firm*—Hill, Steadman & Simpson

[57] ABSTRACT

A recording head and a recording apparatus using this recording head with which while exploiting the merits of an ink-vaporizing laser beam printer it is also possible to maintain good performance during repeated ink transfer. In a printer head 40 and a printer 81 which vaporize a recording substance 22 and transfer it onto a body to be recorded on 50, the radius of the circle having as its circumference the overall length of the inner periphery of an aperture 33 for discharging vaporized recording substance 32 to the body to be recorded on 50 side is 5 μm to 300 μm and is made smaller than the radius of the circle having as its circumference the overall length of the inner periphery of a supply part 27 for supplying the recording substance 22 to this aperture 33; as a result, a sufficient capillary phenomenon drawing action on the recording substance is maintained in the aperture and the amount of recording substance supplied from the supply part to the aperture can be kept sufficient even during repeated transfer, the amount of recording substance supplied corresponding to the transfer rate can be secured and the vaporized amount (transfer amount) can be kept full.

10 Claims, 15 Drawing Sheets

RECORDING HEAD AND RECORDING APPARATUS

BACKGROUND OF THE INVENTION

This invention relates to a recording head and a recording apparatus (especially a laser beam printer).

In recent years, in recording images from video cameras, television and computer graphics and the like, the demand not only of course for monocolor hard copy recording but also for full-color hard copy recording has been increasing. In response to this, printers of various types have been developed and are being deployed in various fields.

Among recording methods used in these printers, there is that wherein an ink sheet coated with an ink layer consisting of a high density transfer pigment dispersed in a suitable binder resin and a body to be printed on such as printing paper coated with a dyeing resin which receives transferred pigment are brought into contact with each other with a fixed pressure and heat corresponding to image information is applied by a thermal recording head positioned over the ink sheet and transfer pigment is thermally transferred from the ink sheet to the pigment receiving layer according to this heating.

The so-called thermal transfer method wherein full-color images are obtained by the operation described above being repeated for each color component of an image signal resolved into yellow, magenta and cyan which are the three subtractive primary colors is attracting attention as an excellent technology with which downsizing and maintenance are easy, recording is instant, and high quality images as good as silver chloride color photographs can be obtained.

FIG. 1 is a schematic front view of a main part of such a thermal transfer type printer. In this printer, a thermal recording head (hereinafter called a thermal head) 1 and a platen roller 3 face each other, and between these an ink sheet 12 consisting of an ink layer 12*a* on a base film 12*b* and a paper to be recorded on 20 consisting of a dyeing resin layer (pigment receiving layer) 20*a* on a paper 20*b* are pinched together and pressed against the thermal head 1 by the platen roller 3.

Ink (transfer pigment) in the ink layer 12*a* selectively heated by the thermal head 1 is transferred in dot form to the dyeing resin layer 20*a* of the paper to be recorded on 20 and thermal transfer recording is thereby accomplished. For this kind of thermal transfer recording, generally a line system wherein a long thermal head is disposed fixed orthogonal to the travel direction of the paper to be recorded on or a serial system wherein a thermal head is moved back and forth in a direction orthogonal to the travel direction of the paper to be recorded on is used.

However, as ink sheets (or ink ribbons) used in this kind of thermal transfer recording, sheets made by mixing a pigment with a suitable binder resin in a weight ratio of about 1:1 and coating this to a thickness of about 1 μm onto a base of polyester film or the like are used, and because this is usually disposable, large quantities of waste material are produced and this is becoming a problem from an environmental conservation point of view.

In this connection, attempts have been made to improve the efficiency with which thermal transfer recording media used. Such attempts include methods which make it possible to regenerate and repeatedly use the ink layer of a thermal transfer recording medium, such as ink layer regeneration methods and multiple-use ink layer constitution methods, and methods which use the thermal transfer recording medium more effectively, such as relative speed methods wherein the head is also moved in the paper feed direction or in the opposite direction thereto.

The present applicant has already proposed in Japanese Non-Laid-Open Patent Application No. H.6-114643 (corresponding U.S. Ser. No. 08/326.377) a non-contact type ink-vaporizing laser beam printer (LBP) which makes it possible to reduce waste material and transfer energy and reduce the size and weight of the printer while making the most of the above-mentioned merits of the thermal transfer recording method.

A printer based on this proposal might for example be constituted as shown in FIG. 2. In this printer, a small space 11 is provided between a recording head (printer head) 10 having a thermally melted liquid ink 22 in a vaporizing section 17 and a body to be recorded on (printing paper) 50 having a receiving layer 50*a* for receiving vaporized (or sublimed) ink.

By irradiation with laser light L, liquified ink 22 held in an ink receptacle 37 of the vaporizing section 17 of the recording head 10 is selectively heated and vaporized through an aperture 13, and this vaporized ink 32 is caused to fly across a space 11 and transferred through a vaporization hole 23 onto the printing paper 50 constituting a body to be recorded on and an image having continuous gradation is obtained. By this operation being repeated for each color component of an image signal resolved into yellow, magenta and cyan which are the three subtractive primary colors, full-color printing can be achieved. The printing paper 50 is fed in the X direction through a distance corresponding to one line of recording by the head 10 at a time.

With this recording system, desirably the printing paper 50 is made to face the recording head 10 for example on the upper side thereof, and laser light L emitted from a laser 18 and focussed by a lens 19 is shone into the vicinity of the upper surface of the ink vaporizing section 17 and causes the vaporized ink 32 to fly upward.

Also, an ink reservoir 15 is provided in a head base 14 transparent to laser light, liquified ink 22 is accommodated in a space bounded by this ink reservoir 15 and a spacer 28 fixed on the head base 14, and the liquified ink 22 is supplied from here to the vaporizing section 17 through an ink supply passage 27 constituting an ink supply part. In this case, to increase the efficiency with which ink is supplied to the ink vaporizing section 17 and vaporized there, fine projections consisting of thin pillars 21 which use the capillary phenomenon to supply and hold ink are provided in the ink vaporizing section 17.

To maintain the above-mentioned space 11 and guide the printing paper 50 moving in the X direction, a protecting plate 29 is fixed on top of the spacer 28. A heater 16 for keeping the above-mentioned ink liquefied is embedded in this protecting plate 29, but this heater can alternatively be disposed inside the ink receptacle (the above-mentioned ink passage 27 and ink reservoir 15).

In the case of a full-color printer the printer head has for example three reservoirs 15Y, 15M and 15C for yellow, magenta and cyan severally provided in a common base 14, and from there ink of each color is supplied to rows of vaporizing sections 17Y, 17M and 17C forming twelve to twenty-four dots.

Laser beams emitted by multi-laser arrays 30 each consisting of twelve to twenty-four lasers (especially semiconductor laser chips) 18 corresponding to the vaporizing sections are severally focussed into the respective vaporizing sections by a microlens array 31 of multiple converging lenses 19.

As described above, with this ink-vaporizing type laser beam printer, the apparatus can be made compact, maintenance is easy, recording is instant, and gradation can be obtained in the recorded image according to the heat energy from the lasers.

By just that amount of ink which is consumed in recording process being sent in a melted state from the reservoirs to the vaporizing sections, ink can be supplied continuously to the vaporizing sections. This is possible because the ink contains almost no binder resin. As a result, because the vaporizing sections involved in recording can be used many times, whereas in the above-mentioned thermal transfer method the ink sheet had to be disposed of after one use only, this type of printer is advantageous from the resource-saving and environmental conservation points of view.

Also, because this printer is ink-vaporizing, recording can be performed without the ink layer and the body to be recorded on (the printing paper) making contact with each other, and as a result the kind of reverse transfer of ink and color mixing at the time of the second printing or subsequent printings seen with the thermal transfer method described above do not occur. At the same time, because a small volume ink reservoir and not the ink sheet described above is used to supply the ink, the printer can be made small and light.

Furthermore, because this recording system uses ink vaporization or sublimation, it is not necessary to heat an ink receiving layer of a body to be recorded on as it is with the thermal transfer method described above, nor is it necessary to press an ink sheet against a body to be recorded on with a high pressure, and this point also is advantageous in reducing the size and weight of the printer. Because the ink layer in the vaporizing section and the body to be recorded on do not make contact with each other, not only is it impossible for thermal fusing to occur between the two, but also recording is possible even when the compatibility of the ink and the receiving layer resin is poor. As a result, the design freedom and range of selection of the ink and the receiving layer resin are markedly widened.

However, in studies of the vaporizing type laser beam printer described above carried out by the present inventors, it was found that although this kind of printer has the above-mentioned various merits, the following kind of problem remains:

Referring to FIG. 2, ink 22 flows through the ink passage 27 and is supplied to the transfer section in a melted state and is finally transferred onto the printing paper 50 by being vaporized and discharged through the aperture 13; however, there is a possibility of the problem arising that when this transfer takes place a number of times there is a break in the ink supply and there stops being any ink in the vicinity of the aperture 13 and transfer consequently becomes impossible.

An object of this invention is to provide a recording head and a recording apparatus using this recording head with which while exploiting the merits of the ink-vaporizing laser beam printer described above it is also possible to maintain good performance during repeated ink transfer.

SUMMARY OF THE INVENTION

This invention provides a recording head which vaporizes a recording substance and transfers it onto a body to be recorded on wherein the radius of the circle having as its circumference the overall length of the inner periphery of an aperture for discharging the vaporized recording substance to the body to be recorded on side is 5 μm to 300 μm and is made smaller than the radius of the circle having as its circumference the overall length of the inner periphery of a supply part for supplying the recording substance to this aperture.

Here, when the aperture and the supply part are circular the above-mentioned 'circle' means that circle itself, but when either is of some other shape such as that of an ellipse or a triangle or a polygon such as a square the above-mentioned 'circle' means the circle shown by converting this shape into the circle of radius r shown by $2\pi r=L$, where L is the length of the inner periphery of the aperture or supply part. In the following, the radius r of the circle obtained by such a conversion will be expressed simply as the 'radius of the aperture' or 'the radius of the supply part'.

In a recording head according to the invention, because the radius (or diameter) of an aperture for discharging vaporized recording substance is made smaller than the radius (or diameter) of a recording substance supply part, a sufficient capillary phenomenon drawing action on the recording substance is maintained in the aperture and sufficient recording substance can be supplied from the supply part to the aperture even during repeated transfer.

Furthermore, at the same time, because the radius of the aperture is specified as being 5 μm to 300 μm, a strong capillary phenomenon action in the aperture is ensured, an amount of recording substance supplied corresponding to the transfer rate can be secured, and it is possible to keep the recording substance vaporization amount (the transfer amount) full.

In the recording head of the invention, the above-mentioned effects can be still be better obtained by making the ratio of the radius of the aperture to the radius of the supply part for supplying the recording substance to this aperture 1:1.5 or over and making the radius of the aperture 8 μm to 200 μm.

In particular, when a recording head according to the invention is so constituted that a recording substance layer faces the body to be recorded on across a gap and vaporized recording substance is made to move across the gap to the body to be recorded on, the best use can be made of the merits of the above-mentioned non-contact type vaporizing laser beam printer.

It is desirable that irradiation with a heating beam of a laser beam printer or the like be applied to the vaporization of the recording substance in this recording head.

The invention also provides a recording apparatus having the above-mentioned recording head.

DETAILED DESCRIPTION OF THE PREFERRED EMBODIMENTS

Figure 1:
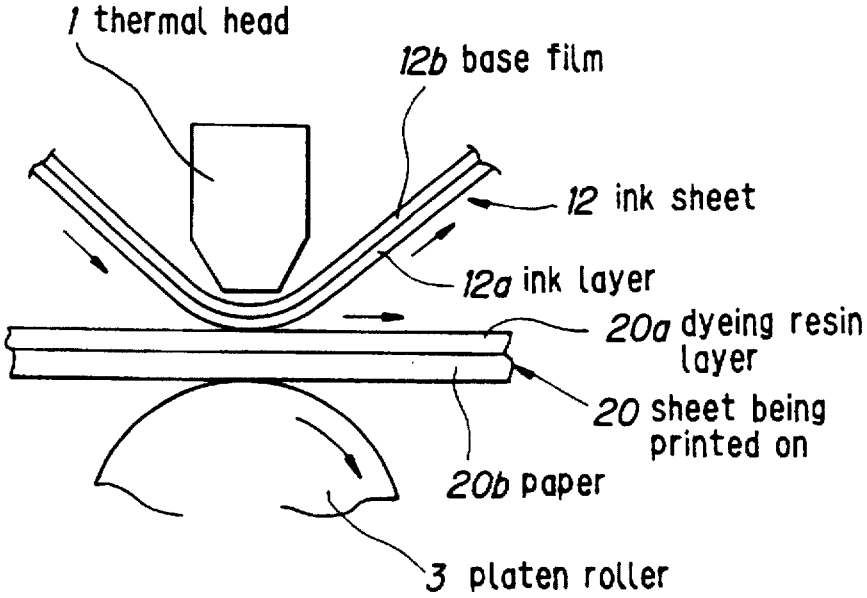
FIG. 1 is a front view of a main part of a printer in which a conventional thermal recording head is used.
Figure 2:
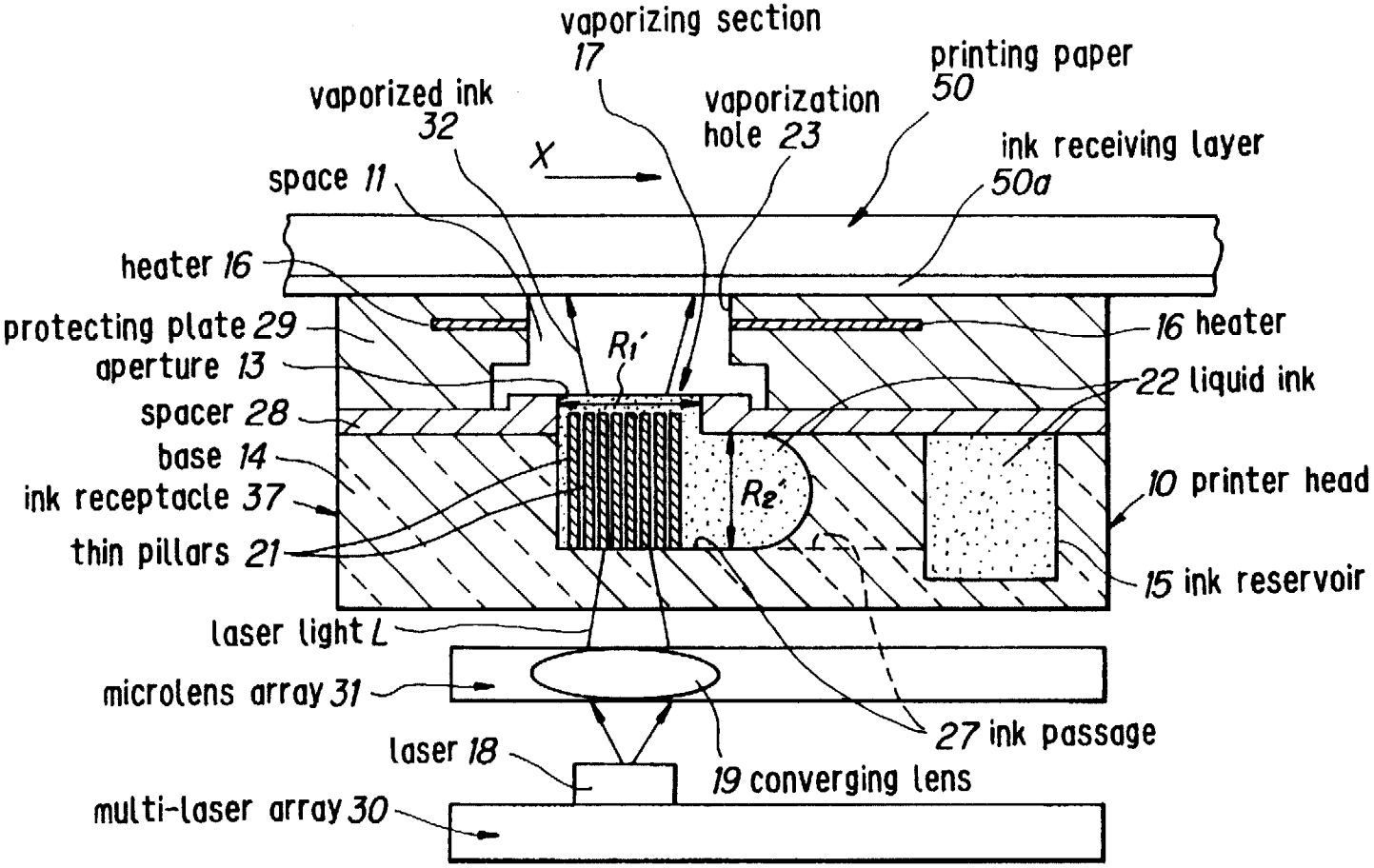
FIG. 2 is a schematic sectional view of a printer head proposed before the completion of this invention.

In the process of arriving at the invention, as a result of carrying out various studies into causes of problems of ink running out during repeated transfer in the vaporization type laser beam printer shown in FIG. 2, the present inventors noticed that the following kinds of phenomena are occurring:

(1) Because as shown in FIG. 2 the diameter $R_1'$ of the aperture 13 is larger than the diameter $R_2'$ of the supply part, the drawing action on the ink caused by the capillary phenomenon is stronger in the supply part 27 than in the aperture 13 and works in the opposite direction (i.e. away from the aperture 13), and consequently once there is little or no ink in aperture 13 the supply of ink to aperture 13 may be difficult or ink may not be supplied again at all.

(2) The amount of a substance moved by the capillary phenomenon generally is greater, the larger the diameter of the capillary is, and because this diameter is not sufficiently large, the supply of ink to the transfer section is insufficient compared to the rate of the transfer being attempted (the printing speed).

Accordingly, to solve the above-mentioned problems, it is necessary to first make the diameter of the aperture (the nozzle) smaller than the diameter of the supply part, and also the diameter of the aperture must be of a size such that a predetermined supply amount is achieved by the capillary phenomenon. The following preferred embodiments were devised based on these points.

Preferred embodiments of the invention will now be described with reference to the accompanying drawings.

FIG. 3 through FIG. 11 show a first preferred embodiment in which the invention is applied to a non-contact type ink-vaporizing laser beam printer (for example a video printer).

Figure 3:
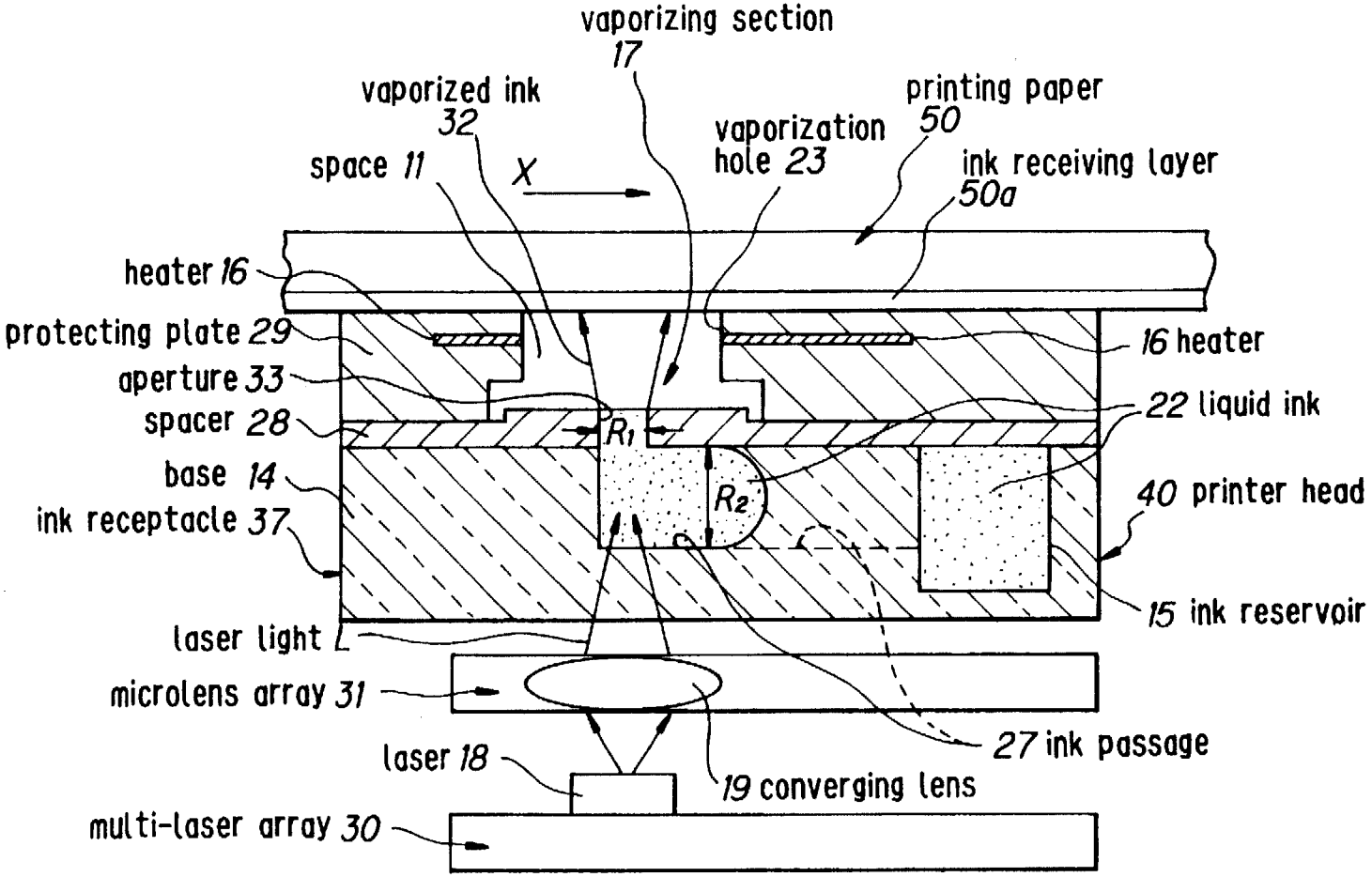
FIG. 3 is a schematic sectional view (a sectional view on the line III—III of FIG. 4) of a printer head according to a first preferred embodiment of the invention.
Figure 4:
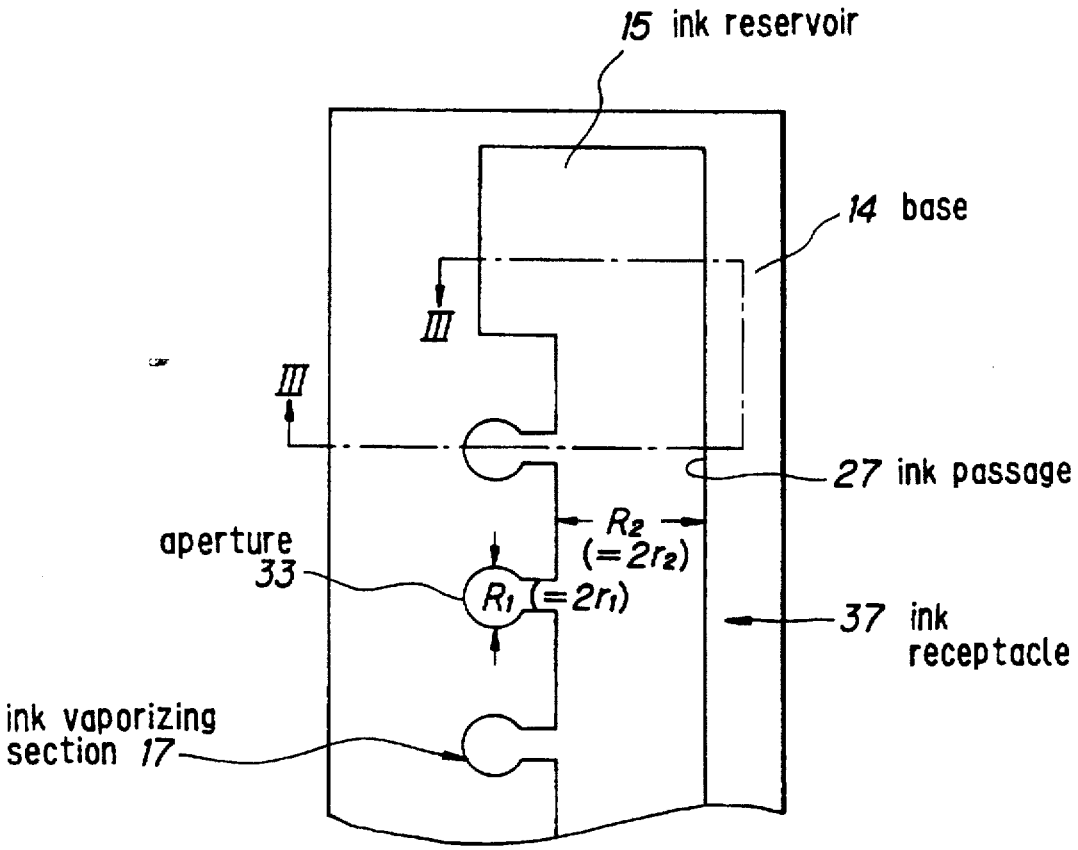
FIG. 4 is a schematic sectional view of a main part of the same printer head.

First, a recording head (printer head) 40 according to this preferred embodiment will be described with reference to FIG. 3 through FIG. 5*a*. As shown in FIG. 3, this printer head 40 is the same as the head described above in that it heats a liquified ink 22 in an ink receptacle 37 with laser light L guided by being passed through a focussing lens (converging lens) 19 from a laser 18 and thereby transfers vaporized or sublimed ink 32 across a space 11 onto a body to be recorded on (printing paper) 50. In practice this printer head 40 comprises the ink receptacle 37 and the laser 18 and the lens 19 and the like integrated and able to move (scan) together.

Figure 6:
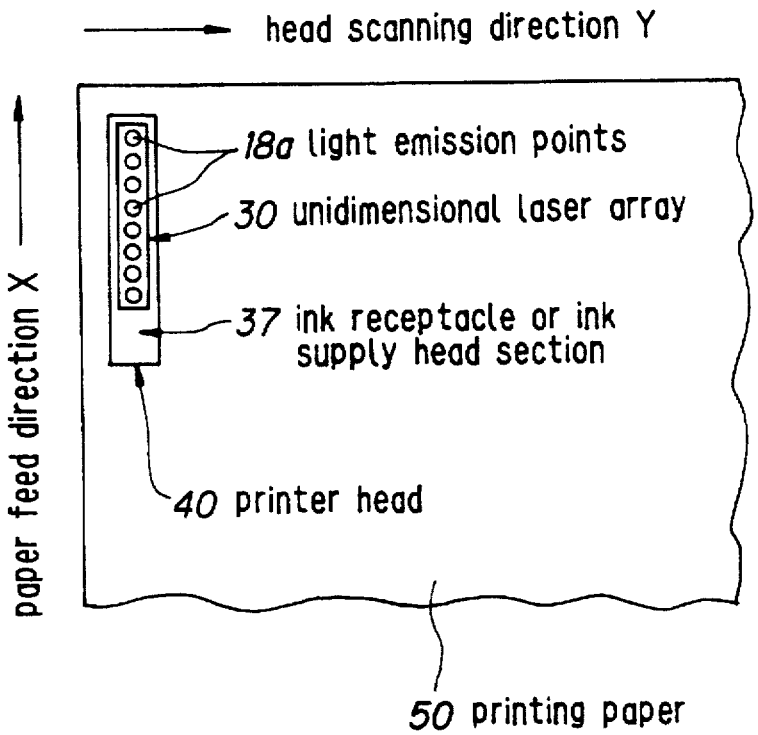
FIG. 6 is a schematic rear view of the same printer head.

FIG. 6 schematically shows a printer head 40 comprising an ink receptacle (or ink supply head section) 37 and a multi (beam) laser array 30 made up of a row of lasers 18 having light emission points 18*a*. This printer head 40 is scanned from the end of the printing paper 50 in the Y direction and the printing paper 50 is intermittently fed in the X direction one line at a time.

Figure 7:
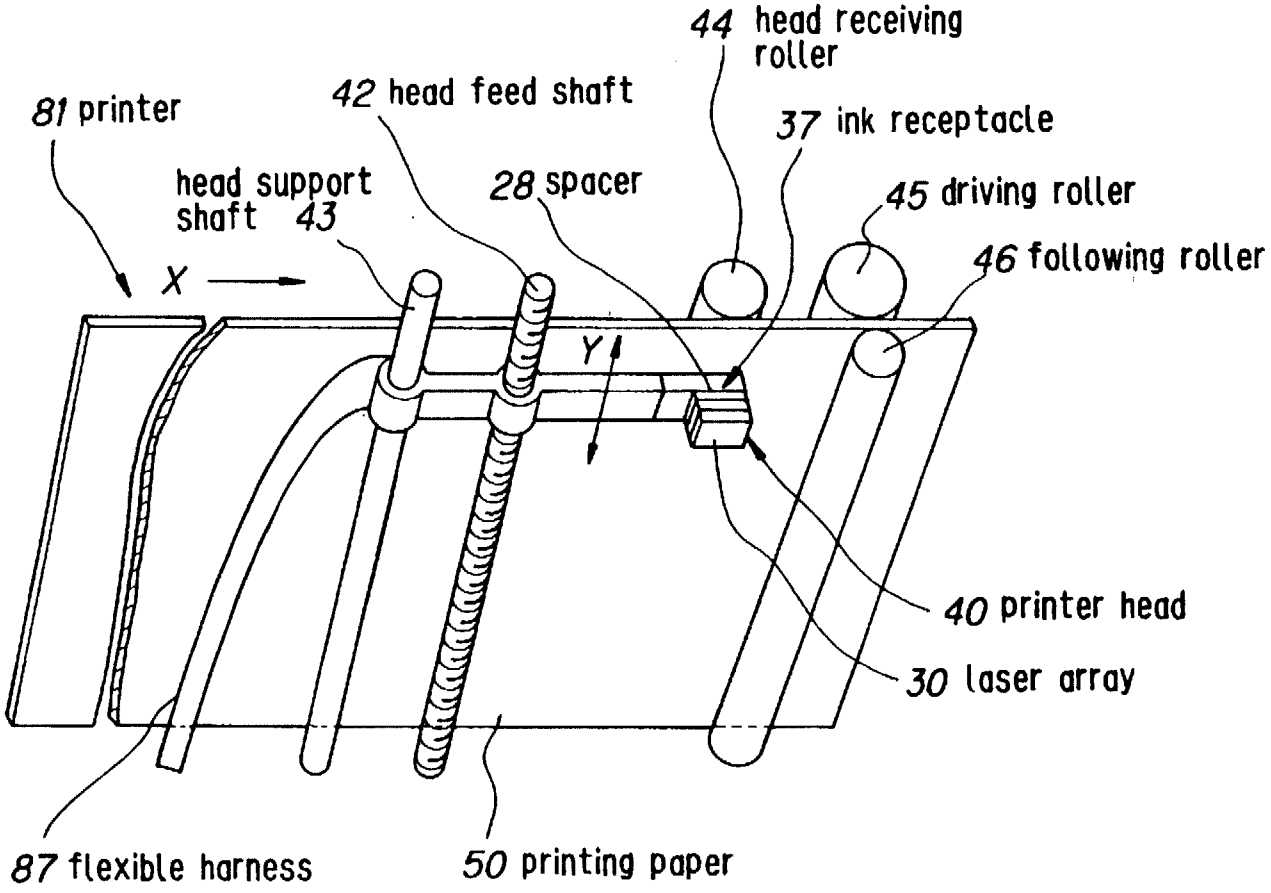
FIG. 7 is a schematic perspective view of the same printer seen from below.

As shown in FIG. 7, this printer head 40 is mounted movably back and forth in a head feed direction Y orthogonal to the printing paper 50 paper feed direction X by way of a head feed shaft 42 consisting of a feed screw mechanism and a head support shaft 43. A head receiving roller 44 for supporting the printing paper 50 as to pinch it, is rotatably mounted above the printer head 40. The printing paper 50 is pinched between and fed in the paper feed direction X by a paper feed driving roller 45 and a following roller 46.

The printer head 40 is connected to a head drive circuit board (not shown in the drawings) by way of a flexible harness 87. When the feed direction of the head 40 is made one line, another head can be added and color printing carried out with one line divided into two by this pair of heads.

Figure 5A:
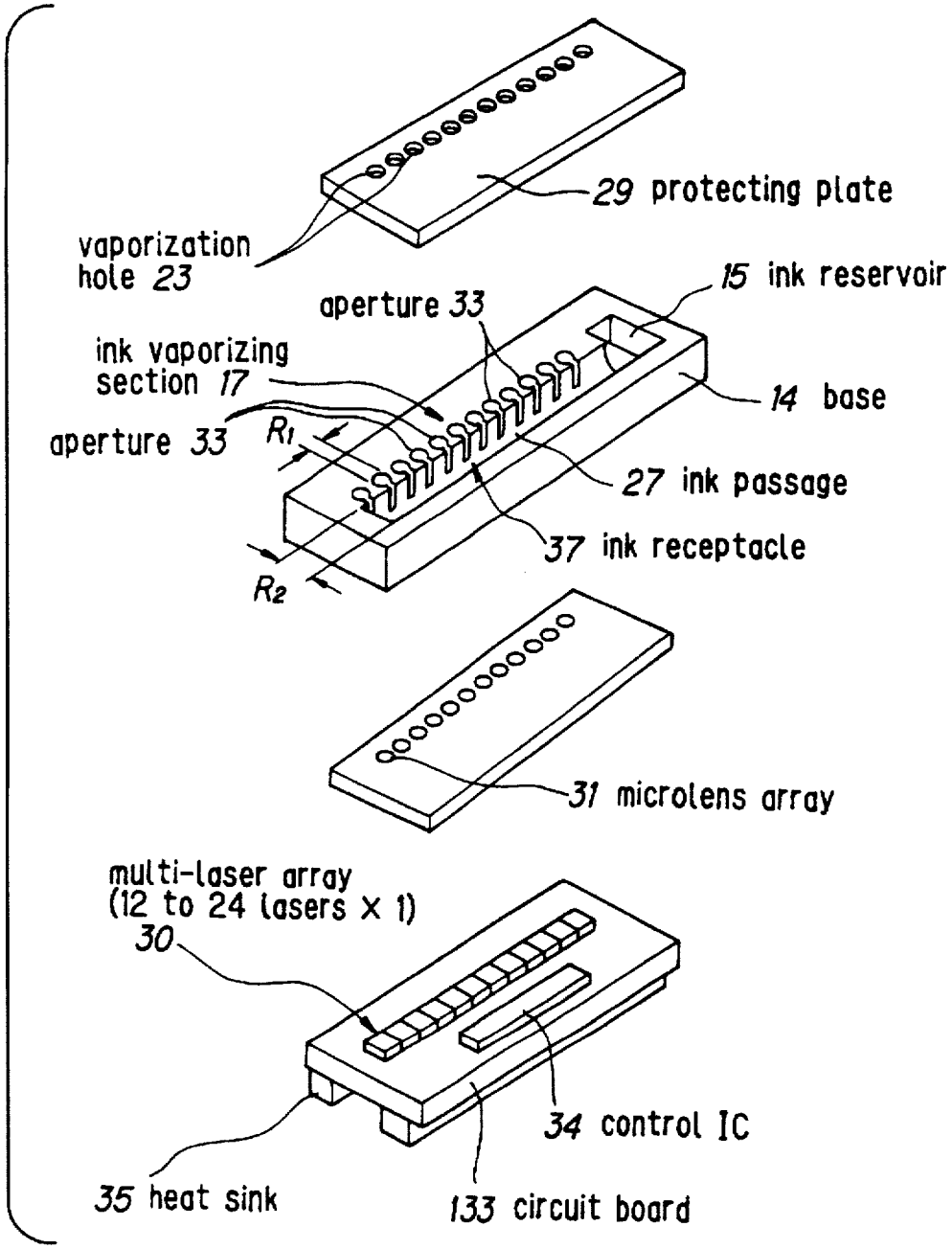
FIG. 5*a* is a schematic exploded perspective view of the same printer head.
Figure 5B:
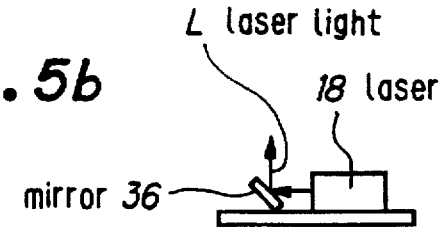
FIG. 5*b* is a schematic view of a laser used in connection with the printer head of FIG. 5*a*.

Also, as shown in FIG. 5*a* and 5*b*, laser beams emitted by a multi-laser array 30 consisting of twelve to twenty-four lasers (especially semiconductor laser chips) 18 disposed in an array and corresponding to the vaporizing sections are severally focussed into the respective vaporizing sections by a microlens array 31 of multiple converging lenses 19 (the reference number 36 denotes a mirror for reflecting the laser beam L through a right angle). The multi-laser array 30 is driven and controlled by a control IC 34 mounted on the circuit board 133, and heat from the circuit board 133 is dissipated by a heat sink 35.

Because in this printer head 40 and the laser beam printer 81 in which this printer head 40 is used and also the recording method which they use ink 22 is heated and vaporized by laser light L from lasers 18 and thereby caused to fly and be transferred to the printing paper 50, the same effects as those discussed in connection with the non-contact type vaporizing laser beam printer described above are obtained.

A constitutional feature to which attention should be paid in the printer head 40 and laser beam printer 81 of this preferred embodiment is that, as shown in FIG. 3 through FIG. 5*b*, the radius $r_1$ (or the diameter $R_1=2\ r_1$) of the small circular aperture 33 through which ink 22 vaporized in the ink vaporizing section 17 is discharged toward the printing paper 50 side is specified as being 5 μm to 300 μm and is made smaller than the radius $r_2$ (or the diameter $R_2=2\ r_2$) of the cross-sectionally circular arc shaped ink supply passage 27 constituting an ink supply part.

As a result, a sufficient capillary phenomenon drawing action on the ink 22 is maintained in the aperture 33, and a sufficient amount of ink 22 can be supplied from the ink supply passage 27 to the aperture 33 even during repeated transfer.

Furthermore, at the same time, because the radius $r_1$ of the aperture is specified as being 5 μm to 300 μm, a strong capillary phenomenon in the aperture 33 is ensured, an amount of supplied ink corresponding to the transfer rate can be secured, and it is possible to keep the ink vaporization amount (transfer amount) fully sufficient. When the radius $r_1$ of the aperture 33 is less than 5 μm the ink transfer amount decreases sharply, and when it exceeds 300 μm the ink transfer amount does not increase and because of the influence of the weight of the ink the supply amount to the aperture is actually liable to fall.

In order to increase the above-mentioned effect still further, it is preferable that the ratio of the radius $r_1$ of the aperture 33 to the radius $r_2$ of the ink supply passage 27 supplying ink to this aperture 33 be made 1:1.5 or over ($r_2/r_1 \geqq 1.5$, and more preferably $r_2/r_1 \geqq 2.0$), and that the radius $r_1$ of the aperture 33 be made 8 μm to 200 μm.

Experiments and analysis results leading to the radius $r_1$ of the aperture 33 thus being specified in the invention as being in the above-mentioned range (5 μm to 300 μm) and in the above-mentioned ratio ($r_2/r_1>1.0$) will now be described.

Figure 8:
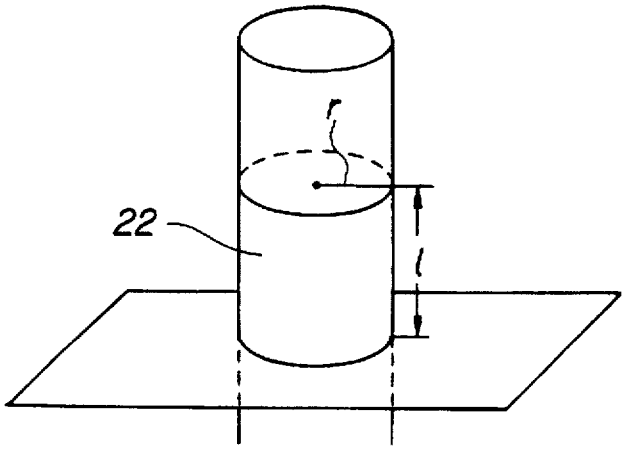
FIG. 8 is a view illustrating an ink movement amount.

FIG. 8 schematically shows a state wherein a liquid 22 like liquified ink has moved through a distance 1 in a capillary with a cross-sectional radius r. This movement distance l is generally expressed by the following theoretical formula (1):

$$l=(\gamma/2\eta)^{1/2}\times r^{0.5}\times t^{0.5} \quad (1)$$

where l: movement distance (cm)

γ: surface tension (dyne/cm)

η: coefficient of viscosity t: time (sec)

Also, l can be expressed by the following empirical formula (2):

$$l=8.45\times r^{.062}\times t^{.072} \quad (2)$$

The supplied amount J of a liquid 22 is given empirically by the following formula (3):

$$J=\pi r^2 l=8.45\times\pi\times r^{2.62}\times t^{0.72} \quad 93)$$

The application range of formula (3) is that r must be below the following capillarity constant:

$$\text{capillarity constant}=\sqrt{(2r/g\rho)}=0.23\ \text{cm}=2300\ \mu. \quad \text{(Equation 1)}$$

However, in practice, r has to be of the order one digit smaller than this, and particularly below 300 μm. When r>300 μm, the influence of weight cannot be ignored and the supplied amount J actually falls.

Figure 10:
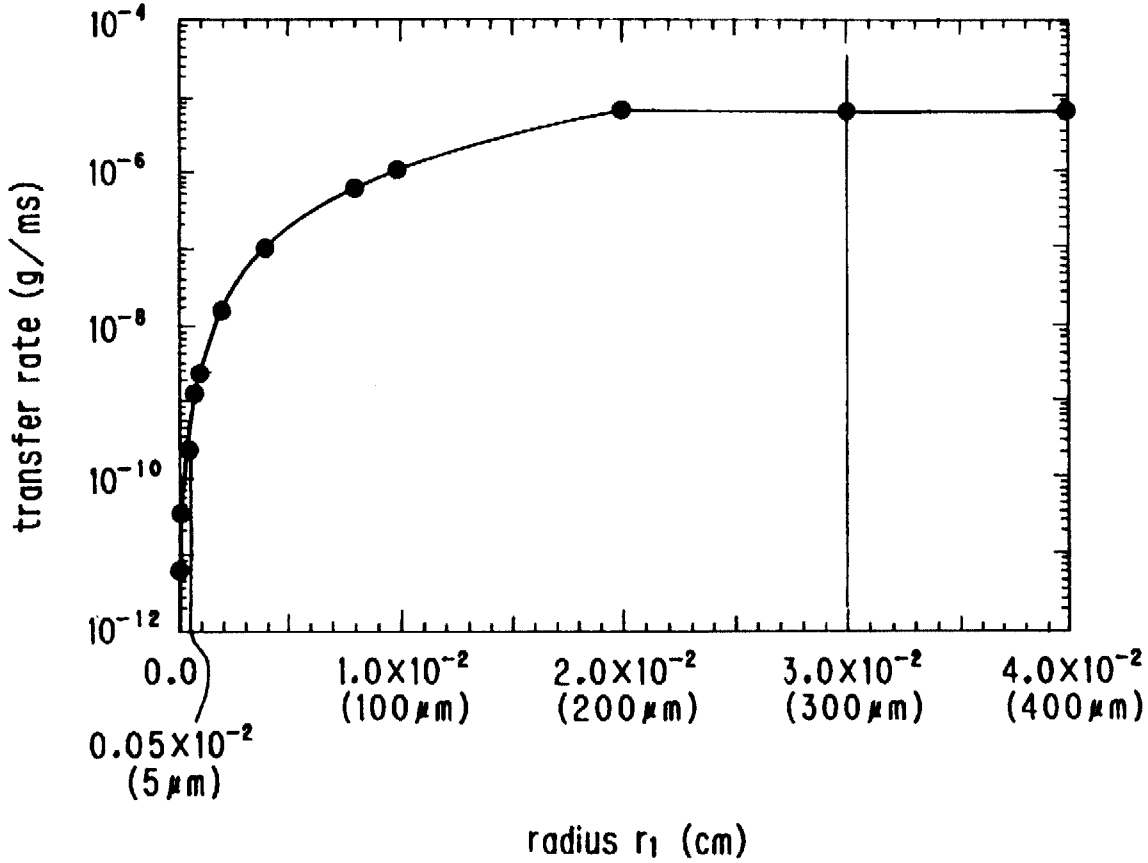
FIG. 10 is a graph showing data on variation of ink transfer amount with variation in the radius $r_1$ of an aperture for ink discharge.
Figure 11:
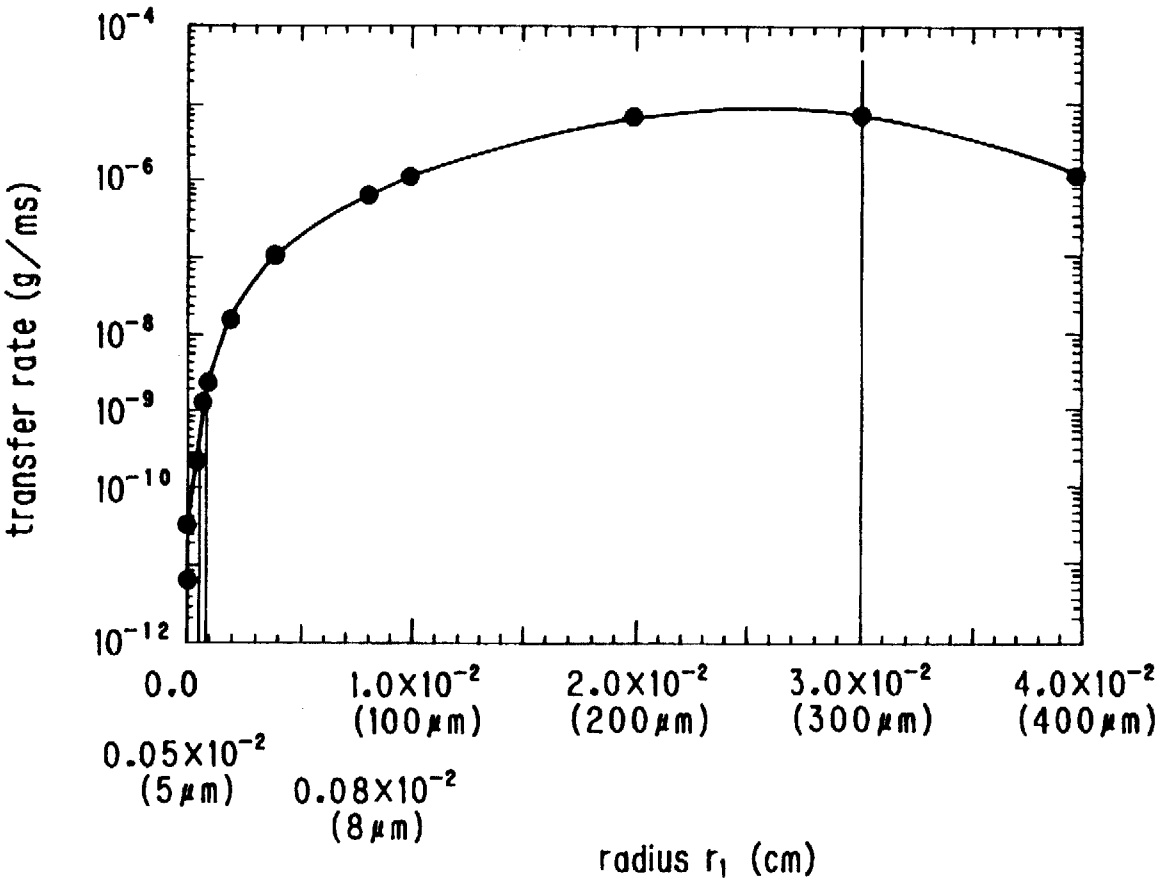
FIG. 11 is a graph showing other data on the same ink transfer amount.

This is also clear from experimental data shown in FIG. 10 and FIG. 11 (the vertical axis is a logarithmic scale) obtained when capillary radius $r_1$ and supplied amount per 1 ms were each measured. Here, the sizes of the aperture 33 and the supply part 27 must be determined using the above formula according to the desired printing rate, but usually it is desirable that 1 dot be formed within 1 ms, and for that it is necessary to move about 0.5 ng in 1 ms. As shown in FIG. 10 (and also FIG. 11), when a typical dispersed pigment is used, for this the radius $r_1$ of the aperture 33 must be 5 μm to 300 μm and preferably 8 μm to 200 μm.

From FIG. 11, because to obtain a color density of optical density (OD)=2 or over a pigment amount of $10^{-9}$ g is necessary, it can be seen that it is necessary to make $r \geqq 8$ μm.

Figure 9:
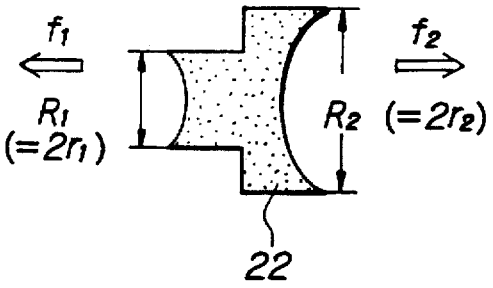
FIG. 9 is a view illustrating the capillary phenomenon.

Next, the relationship between the radius $r_1$ of the aperture 33 and the radius $r_2$ of the ink passage (supply part) 27 will be described with reference to the schematic view of FIG. 9.

Generally, the pulling force f pulling a liquid 22 due to the capillary phenomenon is expressed $f=2\ \gamma/r$ and is inversely proportional to r. To increase the supply amount to the aperture 33, it is necessary that $f_1>f_2$.

Figure 12:
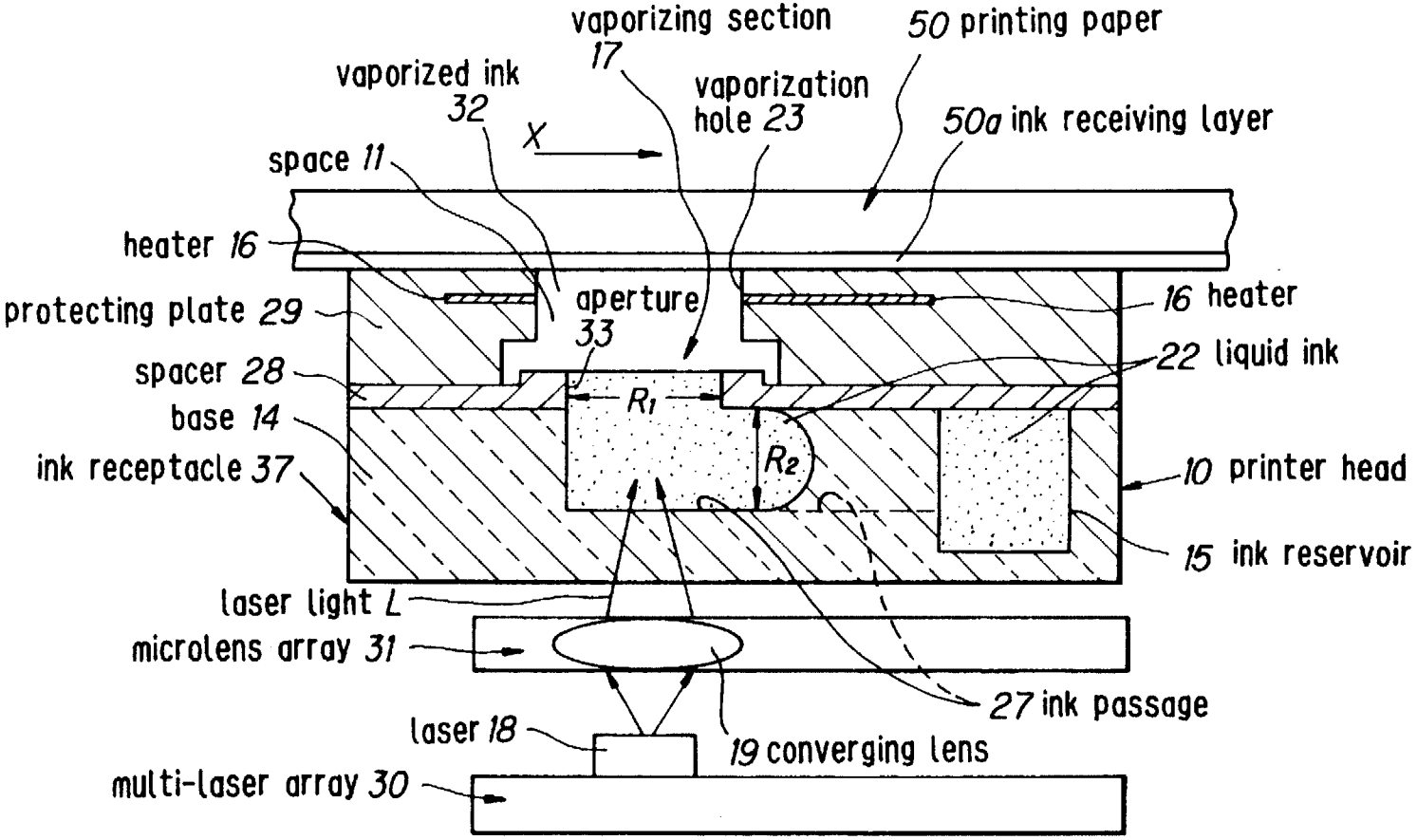
FIG. 12 is a schematic sectional view of a printer head according to a second preferred embodiment of the invention.
Figure 13:
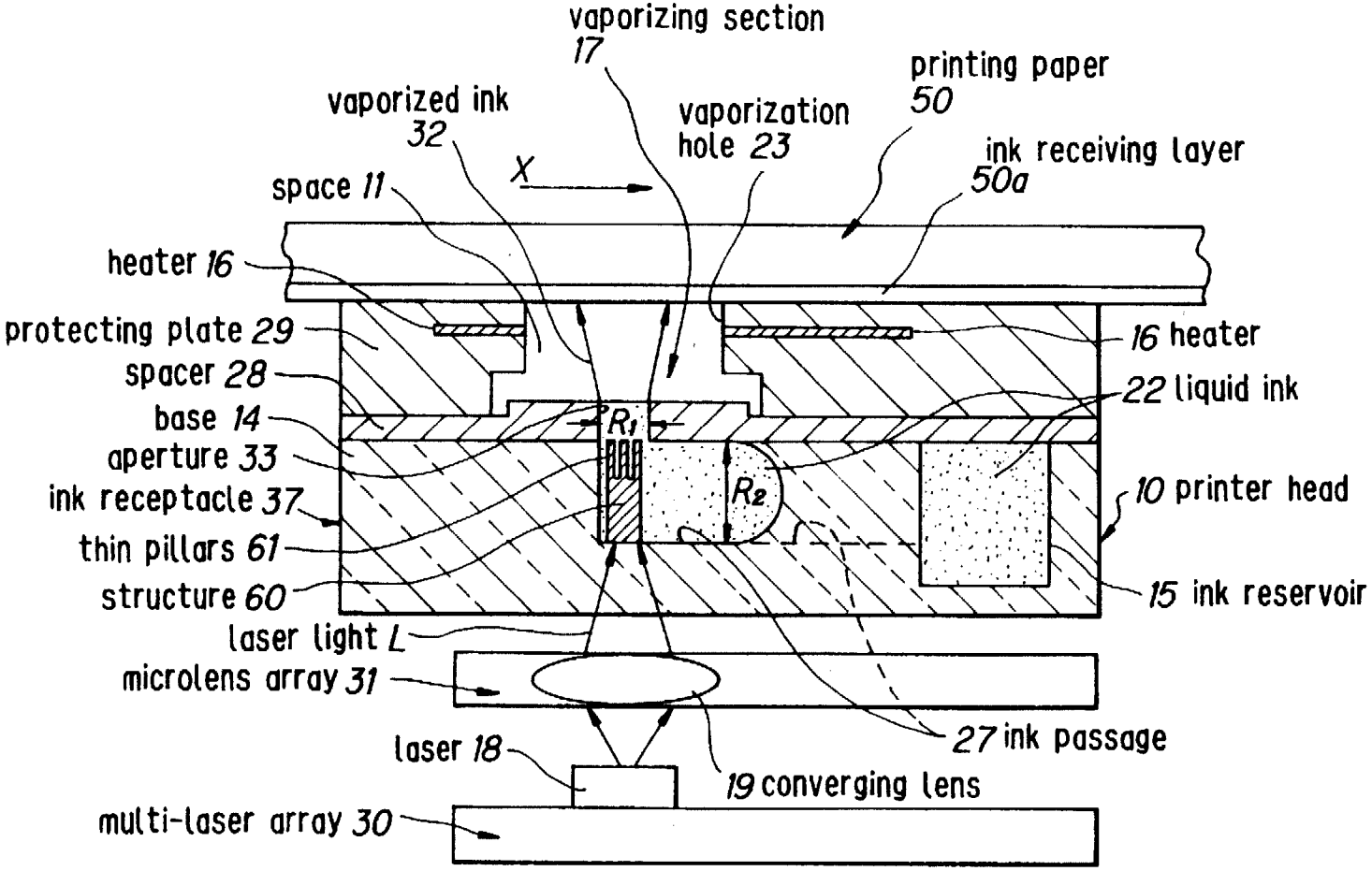
FIG. 13 is a schematic sectional view of a printer head according to a third preferred embodiment of the invention.

For this, it is necessary that $R_1<R_2$ (i.e. $r_1<r_2$). However, in practice it is preferable that $R_2/R_1 \geqq 2$, and it is necessary that at least $R_2/R_1 \geqq 1.5$. When as shown in FIG. 12 the diameter $R_1'$ (or the radius $r_1'$) of the aperture is greater than the diameter $R_2$ (or the radius $r_2$) of the ink passage 27, the above-mentioned ink supply amount falls markedly.

Next, a specific example of this preferred embodiment and comparison examples will be described.

Specific Example 1

In the printer head 40 shown in FIG. 3 to FIG. 7, the radius $r_1$ of the aperture 33 was made 40 μm and the radius $r_2$ of the ink passage 27 was made 100 μm. An ink prepared by adding 2 wt. % of Mitsui Toatsu Chemicals, Inc.'s HM1225 as a laser light absorbing agent to Mitsubishi Chemical Corp.'s disperse pigment HSR2031 which melts at 160° C. and of which the surface tension γ=30 dyn/cm and the coefficient of viscosity η=0.2 P (160° C.) was introduced into the ink receptacle of the head 40.

When semiconductor laser light of emission wavelength 780 nm and output 20 mW was shone into the transfer section of this head, it was possible to transfer onto printing paper ink corresponding to OD2.2 with a Macbeth density meter onto an 80×80 μm area per 1 ms. Continuous printing for over 10 hours was possible without any break occurring in the supply of ink to the aperture 33.

Comparison Example 1

When a transfer experiment was carried out in exactly the same way as in Specific Example 1 except that $r_1$ was made 80 μm and $r_2$ was made 60 μm, printing became impossible after one dot of transfer. There was no ink in the aperture.

Comparison Example 2

When a transfer experiment was carried out in exactly the same way as in Specific Example 1 except that $r_1$ was made 4 μm and $r_2$ was made 60 μm, printing became impossible after one dot of transfer. There was no ink in the aperture.

FIG. 12 shows a second preferred embodiment in which the invention is applied to a non-contact type ink-vaporizing laser beam printer.

According to this preferred embodiment, beneath the aperture 33 for ink discharge of the printer head 40 there is provided another structure 60. This structure 60 may be provided within limits such that it does not markedly obstruct the above-mentioned movement of ink by the capillary phenomenon.

In particular, it is desirable that the structure 60 be mounted in a part of the space under the aperture 33 and be so provided that it does not reach the aperture 33. Also, if portions like thin pillars 61 forming fine spaces are formed in the upper part of the structure 60, capillary phenomenon ink supply and holding effects can also be expected like the thin pillars 21 mentioned above with reference to FIG. 2. Beads can alternatively be dispersed and adhered in place of the thin pillars 61.

FIG. 14*a* to FIG. 16 show a third preferred embodiment of the invention applied to an non-contact type ink-vaporizing laser beam printer.

Figure 14A:
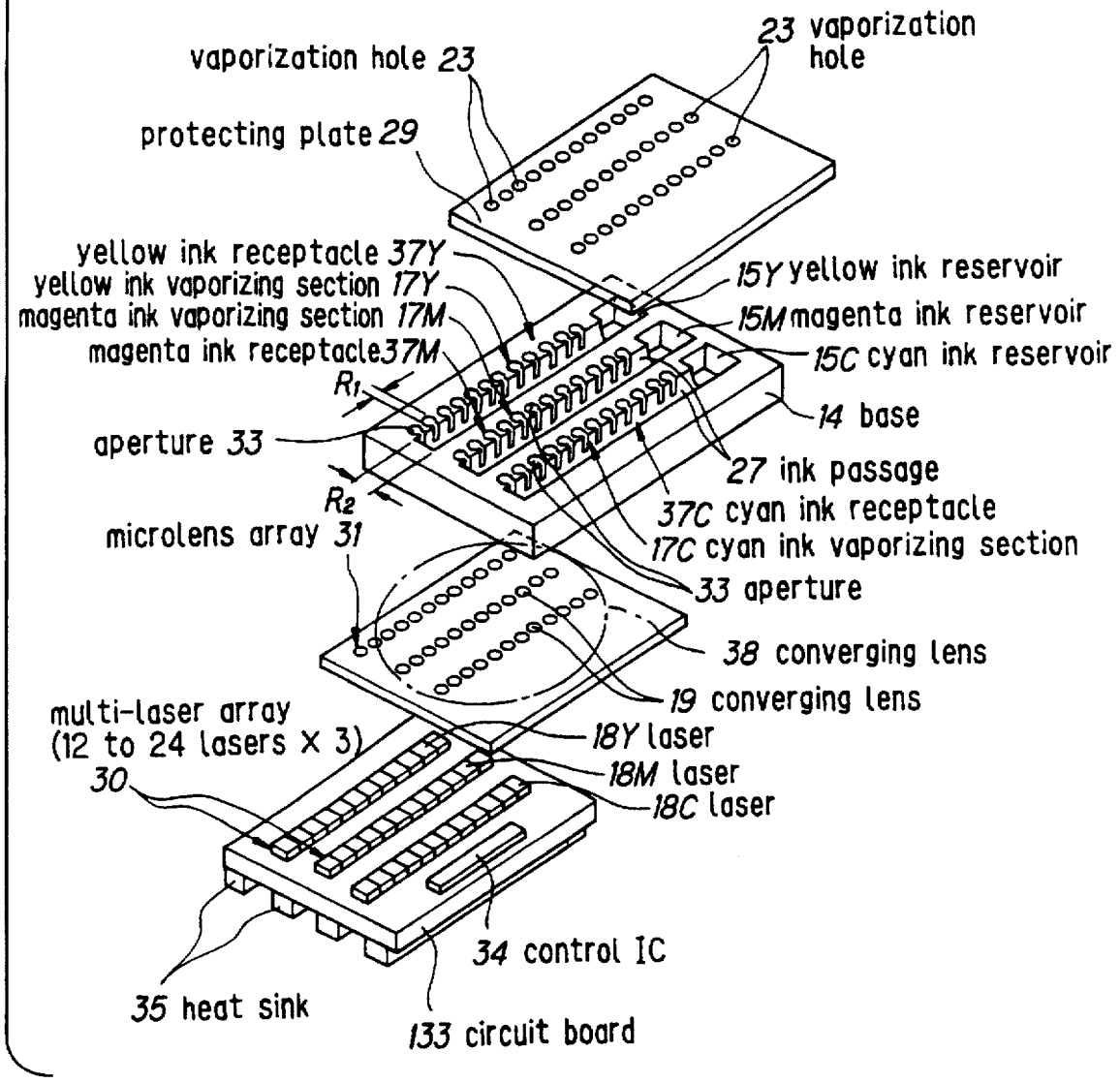
FIG. 14*a* is a schematic exploded perspective view of the same printer head.
Figure 14B:
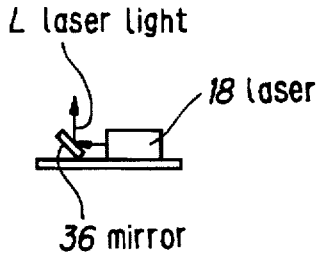
FIG. 14*b* is a schematic view of a laser used in connection with the printer head of FIG. 14*b*.

According to the printer head 40 of this example, as shown in FIGS. 14*a* and 14*b*, for full-color use, ink receptacles like that shown in FIG. 3 to FIG. 5*b* are connected color by color, for yellow 37Y, for magenta 37M and for cyan 37C, and laser light L from lasers 18Y, 18M and 18C of the colors is selectively shone into each of these and ink of each color thereby vaporized.

Figure 15:
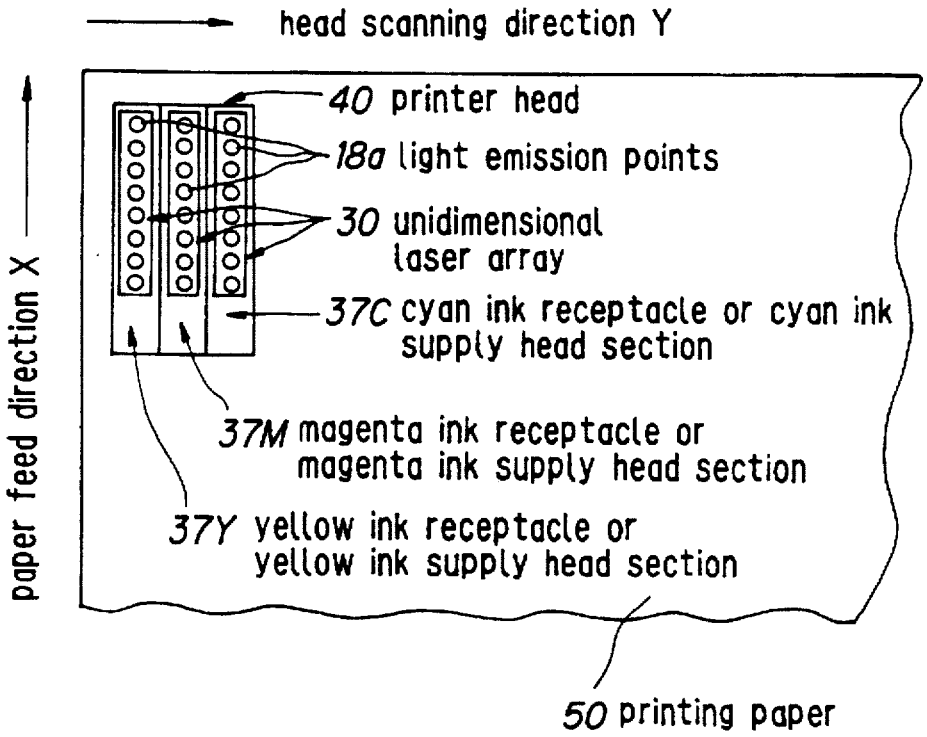
FIG. 15 is a schematic rear view of the same printer head.

The printer head 40 of this example is constituted as shown schematically in FIG. 15, and the ink receptacles (or ink supply head sections) 37Y, 37M and 37C of the colors are integrated with laser arrays 30 (consisting of lasers 18Y, 18M and 18C for the colors).

Also, this whole printer head can be constituted as shown in FIGS. 14*a* and 14*b*, and for example for full-color use yellow, magenta and cyan ink reservoirs 15Y, 15M and 15C severally provided on a common base 14 and ink of the colors supplied therefrom to rows of vaporizing sections 17Y, 17M and 17C constituting 12 to 24 multiple dots.

With respect to the vaporizing sections, laser beams emitted from a multi-laser array 30 of corresponding lasers (especially semiconductor laser chips) 18Y, 18M and 18C disposed in arrays of 12 to 24 each are severally focussed by a microlens array 31 consisting of multiple converging lenses 19 (36 is a mirror for guiding the laser light L through a right angle).

As the converging lenses, the lens system shown in the drawing may be used, but alternatively a single large-diameter converging lens 38 shown with a broken line may be used. This lens 38 is so formed that its refraction path so varies according to the light incidence position that the light exiting position corresponds to the above-mentioned vaporizing sections 17Y, 17M and 17C. The multi-laser array 30 is driven and controlled by a control IC 34 mounted on the circuit board 133 and cooled by a heat sink 35.

Figure 16:
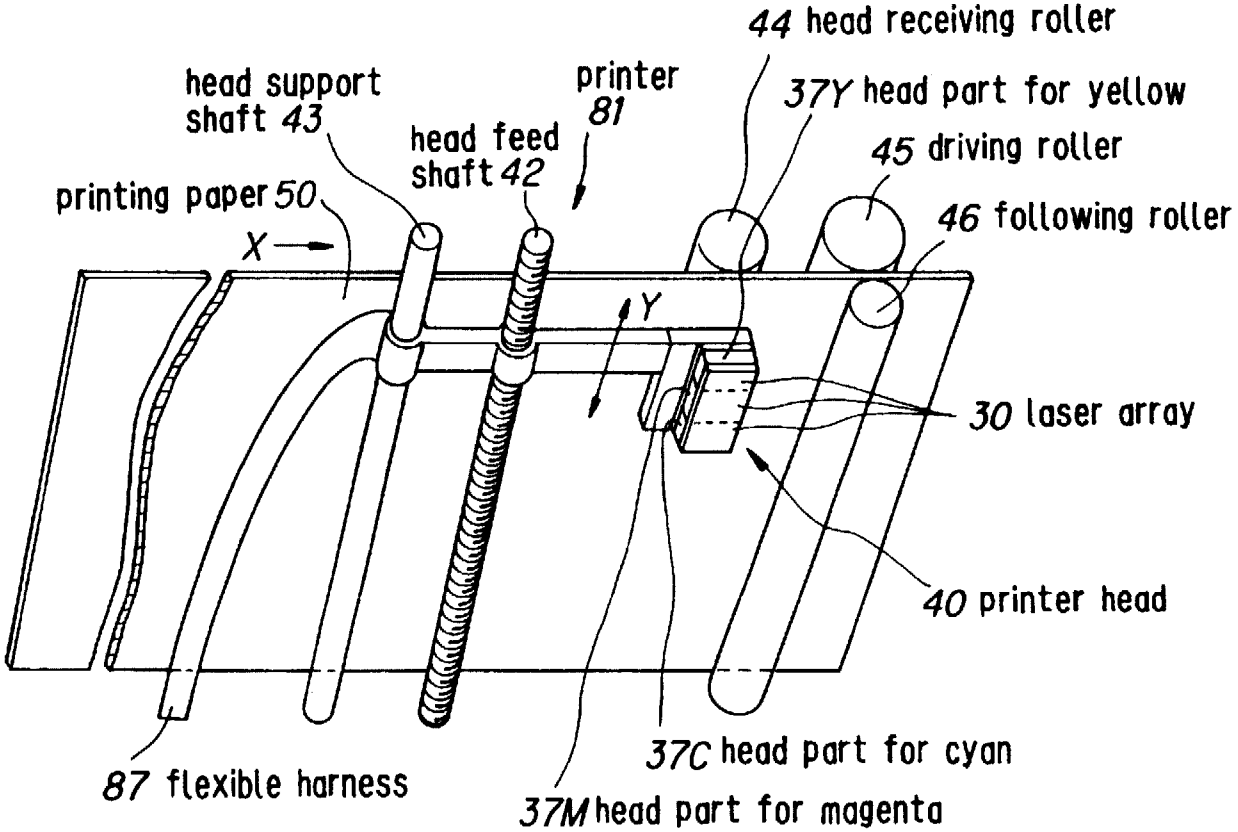
FIG. 16 is a schematic perspective view of a printer according to the third preferred embodiment seen from below.

As shown in FIG. 16, in the overall constitution of the printer 81, the printer head 40 having the head sections 37Y, 37M and 37C for the colors is scanned in the Y direction, and the printing paper 50 is fed through a predetermined pitch in the X direction every time full-color transfer is carried out every line. The rest of the constitution is the same as that described with reference to FIG. 7.

In this preferred embodiment, for full-color use, because the apertures 33 of the ink vaporizing sections of the colors are formed with their radii based on the invention (that is, the radius of the aperture 33 is made 5 μm to 300 μm and made smaller than the radius of the ink passage 27), as described above it is possible to realize an ample transfer amount for each color and as a result it is possible to increase the definition of a full-color image.

Preferred embodiments of the invention are described above, but it is possible to further modify the preferred embodiments described above based on the technological concept of the invention.

For example, the above-mentioned range of the radius of the aperture for ink discharge and the ratio with the radius of the ink passage may be variously changed. Also, the shape of the aperture and the ink passage is not limited to a circle and may be an ellipse or a triangle or a polygon such as a square; in this case, when the inner periphery (or the whole length or total length of the sides) is made L, if the radius $r_1$ of the circle shown by converting to the circle of the radius r shown by $2\pi r=L$ corresponds to the radius $r_1$ of the aperture discussed above, the same effects can be obtained.

The structure and shape of the head and the printer, and the drive mechanism thereof, may be made of other suitable structures and shapes; for example, the printing paper 50 of FIG. 16 may be held stationary and the printer head 40 may be made to scan in both the X direction and the Y direction. Alternatively, instead of the printer head 40 being scanned in the Y direction, a plurality of printer heads 40 may be arrayed in series in the Y direction. Also, other suitable materials may be used as the materials of the parts constituting the head. With respect to the recording ink also, besides carrying out full-color printing with the three colors magenta, yellow and cyan, one-color monocolor or black and white recording can be performed. Also, unlike the examples discussed above, the head may be disposed above the paper and the printer thereby made a type which performs printing from above.

Also, besides performing recording by once liquefying a solid ink and vaporizing this as in the examples discussed above, it is possible to perform recording by directly vaporizing, i.e. subliming, a solid ink by heating it with laser light and it is also possible to accommodate liquified ink (liquid at room temperature) in the ink reservoir. Furthermore, the recording substance may be caused to transfer to the printing paper by phenomena other than the flight mentioned above (for example vaporization), and in this sense the printer need not be non-contact as described above.

Because as described above the invention is so constituted that it vaporizes a recording substance and transfers it onto a body to be recorded on and the radius of the circle having as its circumference the overall length of the inner periphery of an aperture for discharging the vaporized recording substance to the body to be recorded on side is 5 μm to 300 μm and is made smaller than the radius of the circle having as its circumference the overall length of the inner periphery of the supply part for supplying the recording substance to this aperture, a good capillary phenomenon drawing action on the recording substance is maintained in the aperture 33 and the amount of recording substance supplied from the supply part to the aperture can be kept sufficient even during repeated transfer, the amount of supplied recording substance corresponding to the transfer rate can be secured and the vaporized amount (transfer amount) can be kept sufficient.

What is claimed is:

1. A recording head which vaporizes a recording substance and transfers the vaporized recording substance onto a medium on which information is to be recorded, the recording head comprising:

a base;

a protecting plate secured to the base;

a spacer wall secured between the base and the protecting plate;

a recording substance reservoir in said base;

a vaporizing section having an opening in said protecting plate and a single aperture in said spacer wall through which vaporized recording substance is emitted said vaporizing section aperture having a radius;

a passage in said base in fluid communication with said reservoir and said vaporizing section, said passage having a radius and cross section with a radius; and heating means in said protecting plate for vaporizing said recording substance; wherein the recording substance is supplied from said reservoir to said vaporizing section through said passage, the radius of said aperture in said spacer wall is smaller than the radius of the cross section of said passage, a ratio of said radius of said aperture to said radius of said passage being over 1:1.5 and said radius of said aperture being 5 micro-meters to 300 micro-meters.

2. A recording head according to claim 1, wherein said radius of said aperture is 5 micro-meters to 300 micro-meters.

3. A recording head according to claim 1, wherein said radius of said aperture is 8 micro-meters to 200 micro-meters.

4. A recording head according to claim 1, wherein the recording head further comprises an ink supply and holding structure within said vaporizing section.

5. A recording head according to claim 4, wherein said ink supply and holding structure comprises a plurality of pillars.

6. A recording apparatus for recording information onto a medium by vaporizing a recording substance comprising a recording head, said recording head comprising:

a base having a recording substance reservoir;

a plurality of vaporizing sections having a common wall which holds said recording substance and having a plurality of like apertures in said common wall, one aperture being allocated per vaporizing section;

an ink supplying and holding structure within said vaporizing section;

heating means for vaporizing said recording substance; and a passage in said base in fluid communication with said reservoir and said plurality of vaporizing sections, wherein the recording substance is supplied from said reservoir to said plurality of vaporizing sections through said passage;

the radius of each of said apertures is smaller than the radius of a cross section of said passage, a ratio of said radius of said each aperture to said radius of said passage being over 1:1.5; and the radius of each aperture is between 5 micrometers and 300 micro-meters.

7. A recording apparatus according to claim 6, wherein said radius of said aperture is 8 micro-meters to 200 micro-meters.

8. A recording apparatus according to claim 6, wherein the ratio of said radius of said aperture to said radius of said passage is over 1:1.5.

9. A recording apparatus according to claim 6, wherein the recording head further comprises heating means for vaporizing said recording substance.

10. A recording apparatus according to claim 6, wherein said ink supply and holding structure comprises a plurality of pillars.

* * * * *